US011692434B2

(12) United States Patent
Arji et al.

(10) Patent No.: US 11,692,434 B2
(45) Date of Patent: Jul. 4, 2023

(54) REMOTE WELLHEAD INTEGRITY AND SUB-SURFACE SAFETY VALVE TEST

(71) Applicant: SAUDI ARABIAN OIL COMPANY, Dhahran (SA)

(72) Inventors: Faisal M. Arji, Ras Tanura (SA); Meshal A. Al-Amri, Juaymah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 190 days.

(21) Appl. No.: 17/217,040

(22) Filed: Mar. 30, 2021

(65) Prior Publication Data

US 2022/0316317 A1 Oct. 6, 2022

(51) Int. Cl.
*E21B 47/06* (2012.01)
*E21B 47/103* (2012.01)
*E21B 34/02* (2006.01)

(52) U.S. Cl.
CPC ..... *E21B 47/06* (2013.01); *E21B 34/02* (2013.01); *E21B 47/103* (2020.05)

(58) Field of Classification Search
CPC ..... E21B 47/06; E21B 47/103; E21B 34/02
See application file for complete search history.

(56) References Cited

U.S. PATENT DOCUMENTS 7,905,251 B2 3/2011 Flanders
2006/0091310 A1* 5/2006 Furry ..... G01M 3/202 250/330
2008/0156077 A1* 7/2008 Flanders ..... F17D 5/00 700/282
2008/0202770 A1* 8/2008 Bolding ..... E21B 33/068 166/113
2010/0185417 A1 7/2010 Bou et al.
2014/0041863 A1* 2/2014 Dowling ..... E21B 47/01 166/250.01
2017/0138177 A1* 5/2017 Hazel ..... E21B 47/01
2017/0306727 A1* 10/2017 Dykstra ..... E21B 41/00
2019/0284926 A1* 9/2019 Tiss ..... E21B 43/00

FOREIGN PATENT DOCUMENTS

EP 0629804 B1 11/1998
WO 2009/054895 A1 4/2009
WO 2012/018730 A2 2/2012

* cited by examiner

*Primary Examiner* — Blake Michener
*Assistant Examiner* — Yanick A Akaragwe
(74) *Attorney, Agent, or Firm* — Osha Bergman Watanabe & Burton LLP

(57) ABSTRACT

A method for remotely testing wellhead integrity of a well is disclosed. The method includes connecting valves and associated gauges of the well remotely to a supervisory control and data acquisition (SCADA) system, obtaining real time pressure and temperature readings through the SCADA system, detecting, using a thermal infrared camera installed at a wellhead tree and flow lines of the well, potential oil/gas leak, and determining, by the SCADA system and based at least on the real time pressure and temperature readings and a detection result of the thermal infrared camera, integrity of the valves.

8 Claims, 4 Drawing Sheets

REMOTE WELLHEAD INTEGRITY AND SUB-SURFACE SAFETY VALVE TEST

BACKGROUND

In the oil and gas industry, valves at the wellhead and sub-surface safety valves (SSSV) are typically tested manually by an operator at the wellsite. Such testing requires a pressure gauge to be temporarily installed above the crown valve by the operator to measure shut-in wellhead pressure (SIWHP). Manual wellhead integrity and SSSV tests require a large amount of manpower, time, effort and cost, and affect the efficiency of other production activities. Operators often cannot conduct the wellhead integrity and SSSV tests under certain conditions due to bad weather or limited resources. The testing also requires bleeding equipment and other procedures inherent with operational risks to the operator due to presence of $H_2S$ in a confined space, such as in offshore areas.

As those of skill in the art will appreciate, SSSVs are used as a primary isolation barrier for hydrocarbon production and may also be used as an isolation barrier when installing components in or performing maintenance on the wellhead. Particularly in offshore operations, a Surface Controlled Subsurface Safety Valves (SCSSVs), which are remotely operated SSSVs, may also be used.

SUMMARY

In general, in one aspect, the invention relates to a method for remotely testing wellhead integrity of a well. The method includes connecting a plurality valves and associated gauges of the well remotely to a supervisory control and data acquisition (SCADA) system, obtaining real time pressure and temperature readings through the SCADA system, detecting, using a thermal infrared camera installed at a wellhead tree and flow lines of the well, potential oil/gas leak, and determining, by the SCADA system and based at least on the real time pressure and temperature readings and a detection result of the thermal infrared camera, integrity of the plurality of valves.

In general, in one aspect, the invention relates to a system for remotely testing wellhead integrity of a well. The system includes a memory and a computer processor connected to the memory and that obtains real time pressure and temperature readings of a plurality valves and associated gauges of the well, detects, based on images from a thermal infrared camera installed at a wellhead tree and flow lines of the well, potential oil/gas leaks, and determines, based at least on the real time pressure and temperature readings and a detection result of the images, integrity of the plurality of valves, wherein the memory and the computer processor are part of a supervisory control and data acquisition (SCADA) system remote from the well.

In general, in one aspect, the invention relates to a non-transitory computer readable medium (CRM) storing computer readable program code for remotely testing wellhead integrity of a well. The computer readable program code, when executed by a computer, includes functionality for connecting a plurality valves and associated gauges of the well remotely to a supervisory control and data acquisition (SCADA) system, obtaining real time pressure and temperature readings through the SCADA system, detecting, using a thermal infrared camera installed at a wellhead tree and flow lines of the well, potential oil/gas leak, and determining, by the SCADA system and based at least on the real time pressure and temperature readings and a detection result of the thermal infrared camera, integrity of the plurality of valves.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
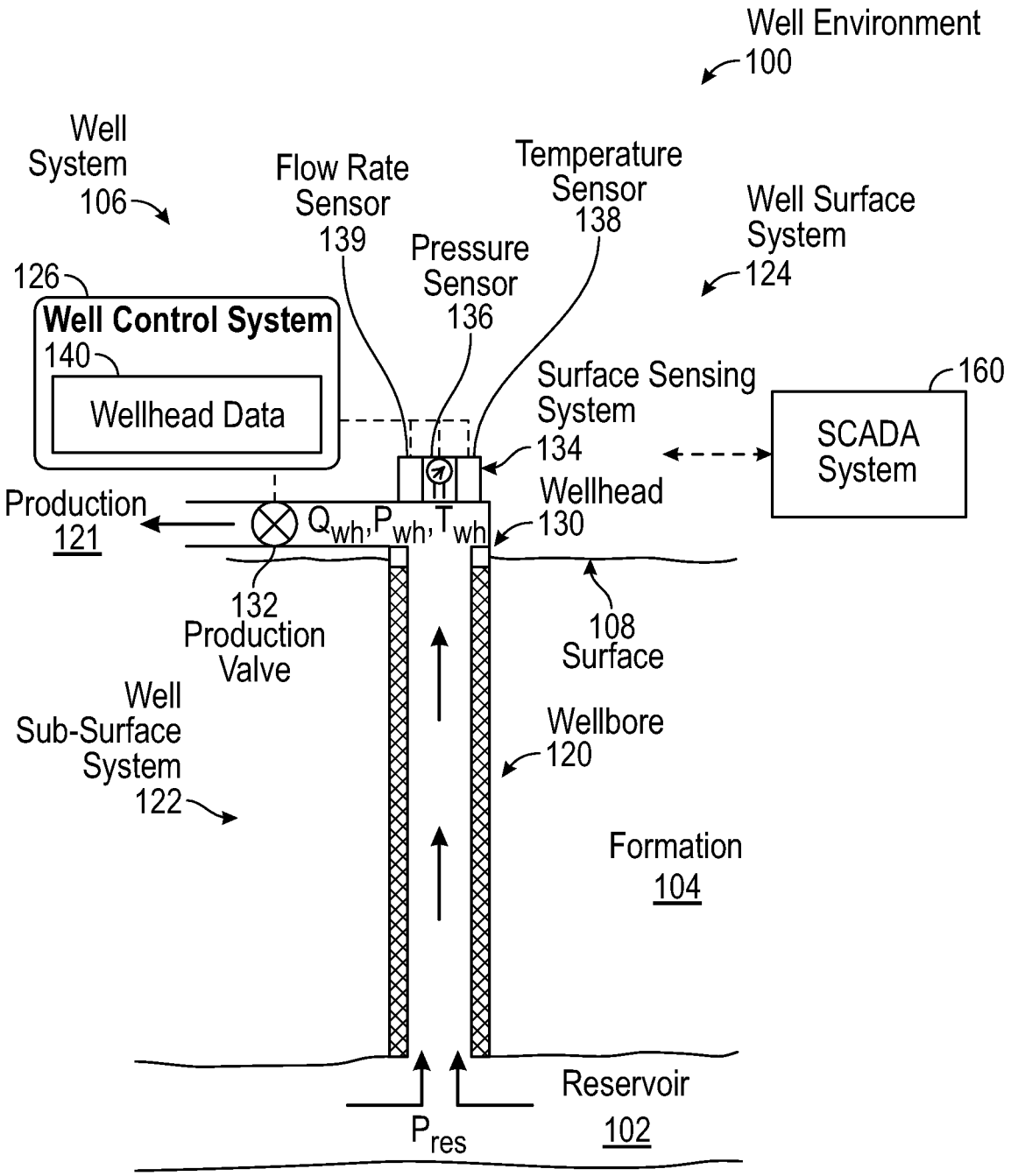
FIGS. 1 and 2 show systems in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the invention provide a method, a system, and a non-transitory computer readable medium for remote testing of various valves at the wellhead as well as remote testing of a sub-surface safety valve (SSSV). In one or more embodiments of the invention, a permanent pressure gauge is installed between the crown valve and the well cap. Thermal infrared camera(s) are installed to detect any oil/gas leaks. In addition, a supervisory control and data acquisition (SCADA) system is used to remotely operate the hydraulic valves. Real time data is transmitted to the SCADA system and analyzed by an artificial intelligence (AI) engine in the cloud to improve the testing methodology. For example, the real time data may be analyzed to determine the required shut-in time for validation and the recommended Wellhead Integrity Test ("WHIT") frequency. Shut-in time for validation is the certain timeframe that a valve is shut in or closed, pressure applied, and required to hold that pressure for validation, e.g., in some embodiments, the shut-in time for validation is 10 minutes. Inventors: did this time from the IDF come from API SPEC 6V or another regulatory specification they are following. The WHIT frequency is how often a wellhead integrity test is performed, e.g., in one or more embodiments, the WHIT frequency is a 6-month period based on well conditions (e.g., field/fluid/composition). As those of skill in the art will appreciate, field/fluid/composition refers to the factors that may affect testing frequency, such as H2S in the oil, high-pressure high temperature wells, presence of paraffins, hydrates issues, etc. Accordingly, adopting optimized WHIT frequency generates value and cost saving of the wellsite operation.

FIG. 1 shows a schematic diagram in accordance with one or more embodiments. More specifically, FIG. 1 illustrates a well environment (100) that includes a hydrocarbon reservoir ("reservoir") (102) located in a subsurface formation ("formation") (104) and a well system (106). The formation (104) may include a porous formation that resides underground, beneath the Earth's surface ("surface") (108). In the case of the well system (106) being a hydrocarbon well, the reservoir (102) may include a portion of the formation (104). The formation (104) and the reservoir (102) may include different layers of rock having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system ("control system") (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (400) described below in FIGS. 4A and 4B and the accompanying description.

The wellbore (120) may include a bored hole that extends from the surface (108) into a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the formation (104) or the reservoir (102) during injection operations, or the communication of monitoring devices (e.g., logging tools) into the formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well (106), and water cut data. In some embodiments, the measurements are recorded in real-time, and are available for review or use within seconds, minutes, or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

In some embodiments, the well sub-surface system (122) includes casing installed in the wellbore (120). For example, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore (120). For example, the central passage may provide a conduit for lowering logging tools into the wellbore (120), a conduit for the flow of production (121) (e.g., oil and gas) from the reservoir (102) to the surface (108), or a conduit for the flow of injection substances (e.g., water) from the surface (108) into the formation (104). In some embodiments, the well sub-surface system (122) includes production tubing installed in the wellbore (120). The production tubing may provide a conduit for the transport of tools and substances through the wellbore (120). The production tubing may, for example, be disposed inside casing. In such an embodiment, the production tubing may provide a conduit for some or all of the production (121) (e.g., oil and gas) passing through the wellbore (120) and the casing.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures (called "wellhead casing hanger" for casing and "tubing hanger" for production tubing) for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

In some embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) ($Q_{wh}$) passing through the wellhead (130).

In some embodiments, the well system (106) communicates with the supervisory control and data acquisition (SCADA) system (160) using wired and/or wireless data communication networks. The SCADA system (160) is a control system of computers, networked data communications and graphical user interfaces for gathering and analyzing real time data, such as the wellhead data (140) and other data collected by the well system (106). Specifically, the SCADA system (160) is used to monitor and control the well system (106). For example, various hydraulic valves, such as the production valve (132) and/or other surface/subsurface valves of the well system (106), are remotely controlled using the SCADA system (160). In particular, each hydraulic valve can be closed and/or opened in response to a control signal sent from, or otherwise activated by the SCADA system (160). In one or more embodiments of the invention, the SCADA system (160) is implemented based on the computing system (400) described in reference to FIGS. 4A-4B below.

Figure 2:
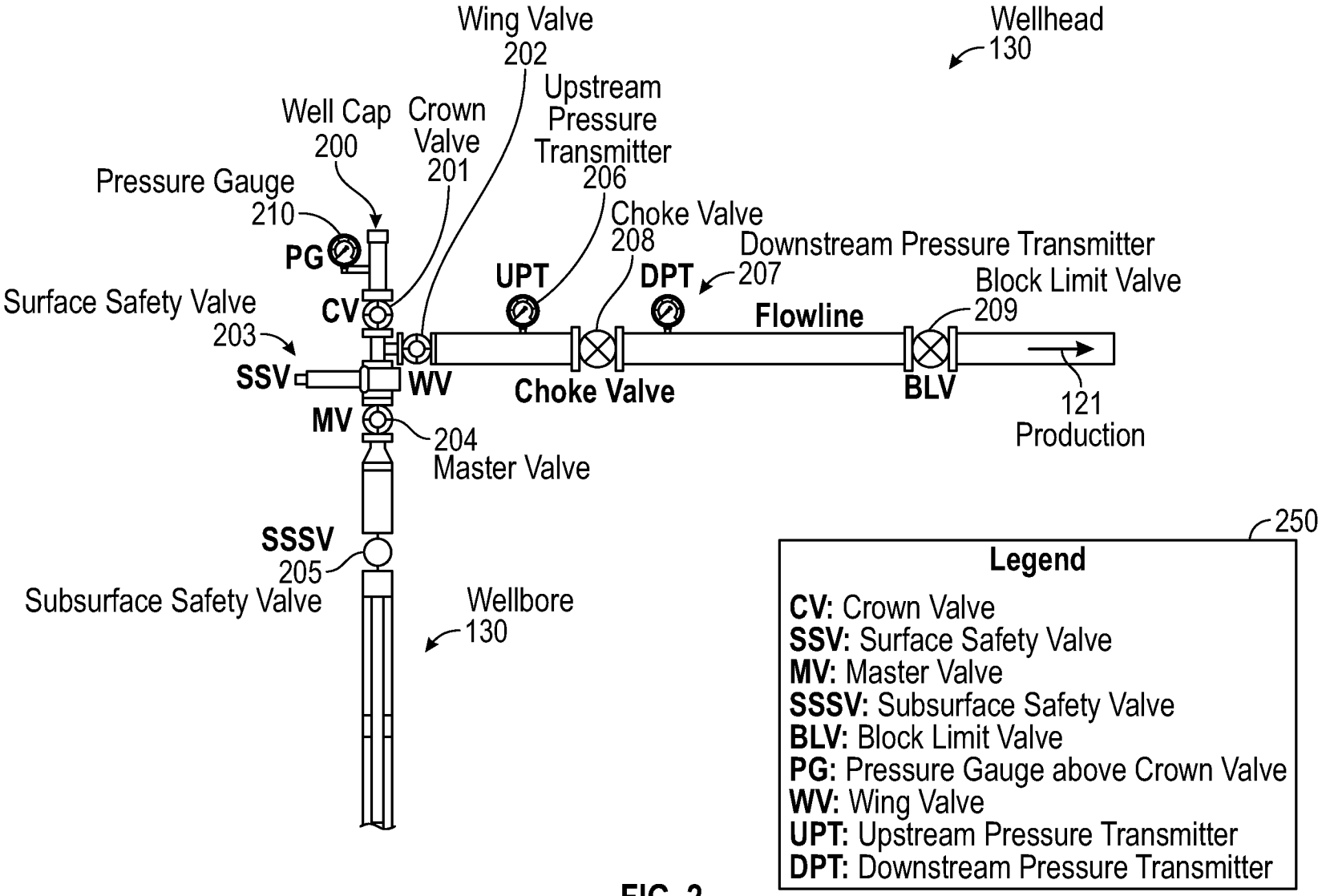

Turning to FIG. 2, FIG. 2 shows a schematic diagram in accordance with one or more embodiments. In one or more embodiments, one or more of the modules and/or elements shown in FIG. 2 may be omitted, repeated, and/or substituted. Accordingly, embodiments of the invention should not be considered limited to the specific arrangements of modules and/or elements shown in FIG. 2.

FIG. 2 illustrates details of the wellhead (130) and the flowline for the production (121) depicted in FIG. 1 above. As shown in FIG. 2 based on the legend (250), the wellhead (130) includes a well cap (200), a crown valve (201), a wing valve (202), a surface safety valve (203), a master valve (204), a subsurface safety valve (205), a upstream pressure transmitter (206), a downstream pressure transmitter (207), a choke valve (208), and a block limit valve (209). The crown valve (201), wing valve (202), surface safety valve (203), master valve (204), choke valve (208), and block limit valve (209) are referred to as valves at the wellhead. In addition, a pressure gauge (210) and/or temperature gauge (not shown) is permanently installed between the crown valve (201) and the well cap (200). In one or more embodiments, the pressure gauge (210) and/or temperature gauge (not shown) correspond to the pressure sensor (136) and temperature sensor (138), respectively, depicted in FIG. 1 above.

The well cap (200) provides access to wellbore for interventions with wireline, coil tubing, slick line etc.

The crown valve (201) is the upper most valve on wellhead. Typically, the crown valve (201) is closed until there is a need to access the well as described above.

The wing valve (202) is for production flow control. In the case of needing to enter a well, this valve would be closed and the master valve would be open.

The surface safety valve (203) is typically a hydraulic failsafe close valve located at surface. The surface safety valve (203) used in the event of an issue in the wellbore/surface equipment and for testing.

The master valve (204) is the main valve controlling flow from the wellbore.

The subsurface safety valve (205) is another safety device located below the surface, e.g., several hundred plus feet below the surface. The subsurface safety valve (205) makes up part of the production tubing and is a means for safety close in the case of uncontrolled release of hydrocarbons, such as a kick. Also, the subsurface safety valve (205) may be used as a barrier when testing or needed to perform maintenance on the wellhead.

The choke valve (208) is used for flow restriction in the event of bleeding down pressure during testing, loss of pressure in the wellbore, temperature management, etc.

The upstream pressure transmitter (206) is a pressure/temperature gauge located upstream of choke valve (208) and provides pressure data prior to reaching the choke valve (208).

The downstream pressure transmitter (207) is a pressure/temperature gauge downstream of choke valve (208) and provides pressure data after passing the choke valve (208).

The block limit valve (209) is a valve for testing, maintenance and isolation purposes, e.g., if the upstream pressure transmitter (206), downstream pressure transmitter (207), or choke valve (208) were being replaced.

The pressure gauge (210) located above the crown valve (201) is for testing each component of the wellhead.

The shut-in wellhead pressure refers to the initial wellhead pressure from the reservoir as seen at surface and is a base line pressure for testing purposes.

The initial manifold pressure refers to the initial pressure downstream of wellhead and is a base line pressure for testing purposes.

In one or more embodiments, all valves at the wellhead, gauges, and the SSSV shown in FIG. 2 are remotely operable hydraulic valves that are operated remotely through the SCADA system (160) depicted in FIG. 1 above. In particular, each of the valves at the wellhead and the SSSV can be closed and/or opened in response to a control signal sent from, or otherwise activated by the SCADA system (160). All pressure and temperature readings are transmitted to the SCADA system (160) in real time and are analyzed by an artificial intelligence (AI) engine in the cloud. One or more thermal infrared camera is installed at the wellhead (130) to detect any oil/gas leaks of the valves at the wellhead, production lines, manifolds and/or the SSSV. In one or more embodiments, one IR camera is installed for each wellhead valve and SSSV in FIG. 2 and each IR camera is also operated remotely through the SCADA system (160). In one or more embodiments, the valves at the wellhead, SSSV, and flow lines are imaged by the IR camera(s) to detect any valve leak during automatic testing of the valves at the wellhead and SSSV. In one or more embodiments, automatic testing of the valves at the wellhead and SSSV is performed using the method described in reference to FIG. 3 below. The method eliminates the need of visiting the wellsite by a human operator to conduct periodic activities pertaining to testing valves at the wellhead and SSSV.

Figure 3:
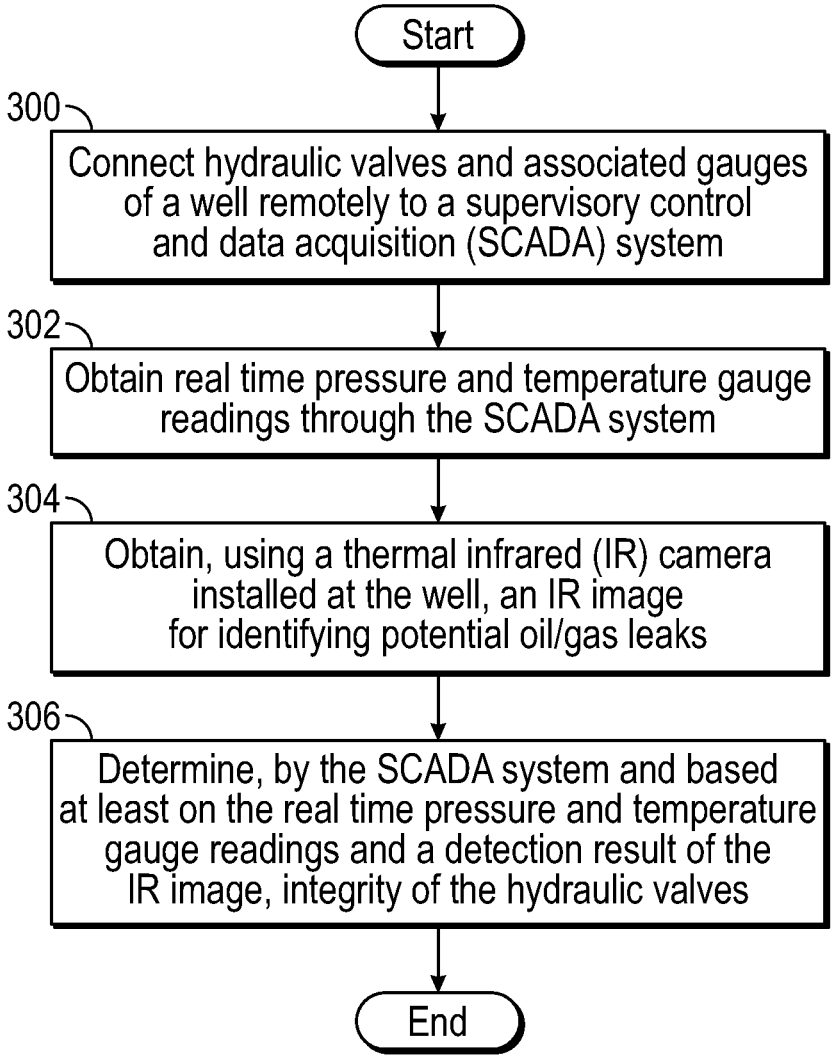
FIG. 3 shows a flowchart in accordance with one or more embodiments.

FIG. 3 shows a flowchart in accordance with one or more embodiments. One or more blocks in FIG. 3 may be performed using one or more components as described in FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially in Block 300, the hydraulic valves and associated gauges of the well are remotely connected to a supervisory control and data acquisition (SCADA) system. Remotely connecting the hydraulic valves and associated gauges includes configuring and activating various networking equipment and communication protocols of the SCADA system. In one or more embodiments, the hydraulic valves and associated gauges are connected as depicted in FIG. 2 above. In particular, a pressure gauge is permanently installed between the well cap and the crown valve.

In Block 302, real time pressure and temperature gauge readings are obtained through the SCADA system. In one or more embodiments, the real time pressure and temperature gauge readings are provided to an artificial intelligence (AI) engine in the cloud for analysis. In one or more embodiments, the real time pressure and temperature gauge readings are obtained under different open/close configurations of the hydraulic valves as controlled by the SCADA system. For example, the real time pressure and temperature gauge readings may be obtained under the following four open/close configurations to test valves at the wellhead. In each of the open/close configurations, the valves at the wellhead and the SSSV are closed and/or opened in response to one or more control signals sent from a remote system, or otherwise activated remotely, e.g., by the SCADA system (160) depicted in FIG. 1 above.

In the first open/close configuration, the subsurface safety valve, master valve, wellhead valve, crown valve, and block limit valve are closed to record the initial manifold pressure using the downstream pressure transmitter.

Following the first open/close configuration and in the second open/close configuration, the subsurface safety valve, master valve, wellhead valve, and crown valve are opened with the block limit valve closed to record the initial shut-in wellhead pressure (SIWHP) using the permanently installed pressure gauge between the well cap and the crown valve. The pressure gauge readings of the permanently installed pressure gauge, the upstream pressure transmitter, and the downstream pressure transmitter are compared with each other to validate gauge accuracy. All pressure gauge readings are observed for 10 minutes to record pressure changes, if any. If all three following conditions are true over the 10 minutes period: DPT=SIWHP, UPT=SIWHP, and PG=SIWHP, then the block limit valve is determined as holding (i.e., no leakage). In particular, the gauge readings from the downstream pressure transmitter, the upstream pressure transmitter, and the pressure gauge between the well cap and the crown valve are denoted as DPT, UPT, and PG, respectively.

Following the second open/close configuration and in the third open/close configuration, the wellhead valve is closed and the block limit valve is opened to observe all pressure gauge readings for 10 minutes and record pressure changes, if any. If both following conditions are true over the 10 minutes period: UPT=initial manifold pressure=DPT and PG=SIWHP, then the wellhead valve is determined as holding (i.e., no leakage).

Following the third open/close configuration and in the fourth open/close configuration, the crown valve is closed followed by closing the master valve and opening the wellhead valve. If both following conditions are true over the 10 minutes period: UPT=initial manifold pressure=DPT and PG=SIWHP, then the crown valve and the master valve are determined as holding (i.e., no leakage).

Subsequent to the first, second, third and fourth open/close configurations, the crown valve is opened to bleed the pressure to the production line. Specifically, BLV and WV are open. MV is closed and CV bleeds the trapped pressure between CV and MV into the flowline.

In another example, the real time pressure and temperature gauge readings may be obtained under the following four open/close configurations to test the subsurface safety valve. The subsurface safety valve may be tested independent of testing the valves at the wellhead described above.

In the fifth open/close configuration, the master valve, wellhead valve, crown valve, and subsurface safety valve are closed.

Following the fifth open/close configuration and in the sixth open/close configuration, the subsurface safety valve, master valve, and crown valve are opened to record the initial shut-in wellhead pressure at the pressure gauge permanently installed between the well cap and the crown valve.

Following the sixth open/close configuration and in the seventh open/close configuration, the subsurface safety valve is closed and the wellhead valve is opened to bleed the pressure downstream through the flowline.

Following the seventh open/close configuration and in the eighth open/close configuration, the wellhead valve is closed to monitor pressure build-up for 30 minutes at the pressure gauge permanently installed between the well cap and the crown valve. If the pressure at PG equal to initial manifold pressure, downstream pressure over the 30 minutes period, then the subsurface safety valve is determined as holding (i.e., no leakage).

In Block 304, thermal infrared (IR) images are obtained using one or more IR cameras installed at the wellhead and flow lines of the well. The IR images are analyzed to generate detection result(s) of potential oil/gas leaks at the hydraulic valves. In one or more embodiments, the IR images are obtained through the SCADA system and analyzed by the AI engine to generate the detection results. For example, digital image processing techniques may be employed by the AI engine in generating the detection results. In one or more embodiments, the leakage status of the valves at the wellhead and the subsurface safety valve determined in Block 302 is correlated with the IR image detection results using the AI engine and compiled by the SCASA system.

In Block 306, the integrity of the hydraulic valves of the well is determined by the SCADA system. In particular, the integrity of the hydraulic valves is determined based on the real time pressure and temperature gauge readings and the detection result of the IR images from the thermal infrared cameras. Specifically, the integrity means whether leakage exists at a particular valve or not.

The method described above allows for automatic remote valve testing and does not require any operator to be on location. The automatic testing increases the operation efficiency, reduces the operational cost, and improves the operation safety without the need for operator visit to the well.

Figure 4A:
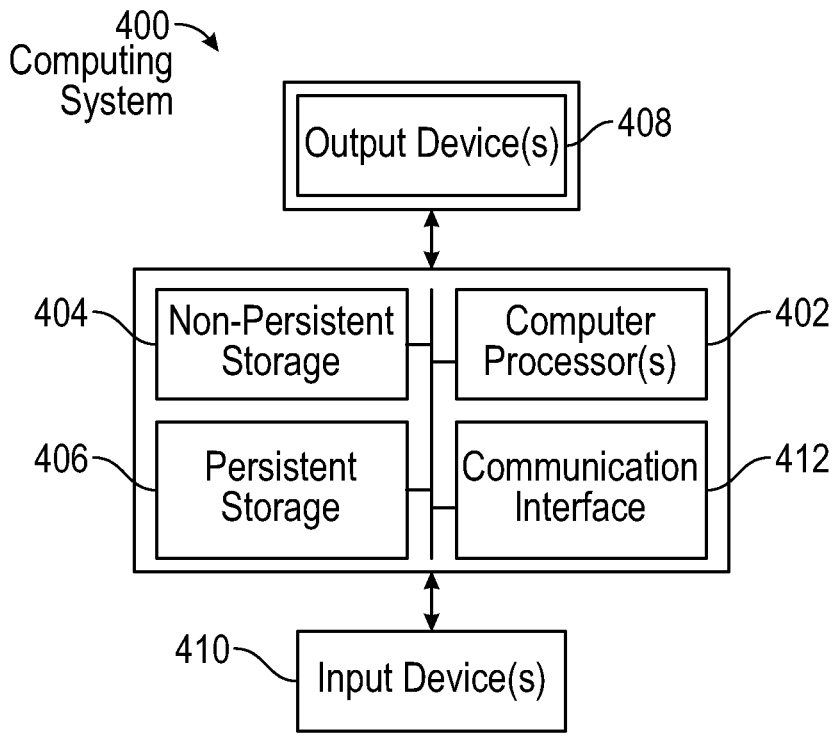
FIGS. 4A and 4B show a computing system in accordance with one or more embodiments.

Embodiments may be implemented on a computing system. Any combination of mobile, desktop, server, router, switch, embedded device, or other types of hardware may be used. For example, as shown in FIG. 4A, the computing system (400) may include one or more computer processors (402), non-persistent storage (404) (e.g., volatile memory, such as random access memory (RAM), cache memory), persistent storage (406) (e.g., a hard disk, an optical drive such as a compact disk (CD) drive or digital versatile disk (DVD) drive, a flash memory, etc.), a communication interface (412) (e.g., Bluetooth interface, infrared interface, network interface, optical interface, etc.), and numerous other elements and functionalities.

The computer processor(s) (402) may be an integrated circuit for processing instructions. For example, the computer processor(s) may be one or more cores or micro-cores of a processor. The computing system (400) may also include one or more input devices (410), such as a touchscreen, keyboard, mouse, microphone, touchpad, electronic pen, or any other type of input device.

The communication interface (412) may include an integrated circuit for connecting the computing system (400) to a network (not shown) (e.g., a local area network (LAN), a wide area network (WAN) such as the Internet, mobile network, or any other type of network) and/or to another device, such as another computing device.

Further, the computing system (400) may include one or more output devices (408), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (402), non-persistent storage (404), and persistent storage (406). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

Figure 4B:
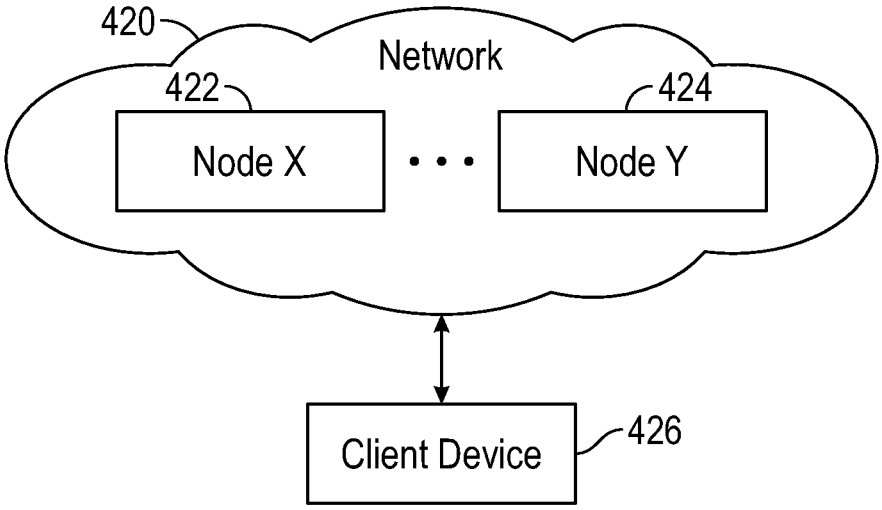

The computing system (400) in FIG. 4A may be connected to or be a part of a network. For example, as shown in FIG. 4B, the network (420) may include multiple nodes (e.g., node X (422), node Y (424)). Each node may correspond to a computing system, such as the computing system shown in FIG. 4A, or a group of nodes combined may correspond to the computing system shown in FIG. 4A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system (400) may be located at a remote location and connected to the other elements over a network.

Although not shown in FIG. 4B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (for example, node X (422), node Y (424)) in the network (420) may be configured to provide services for a client device (426). For example, the nodes may be part of a cloud computing system. The nodes may include functionality to receive requests from the client device (426) and transmit responses to the client device (426). The client device (426) may be a computing system, such as the computing system shown in FIG. 4A. Further, the client device (426) may include or perform all or a portion of one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A method for remotely testing wellhead integrity of a well, the method comprising:

connecting a plurality valves and associated gauges of a wellhead of the well remotely to a supervisory control and data acquisition (SCADA) system, the wellhead comprising a T-shaped junction where a wellbore terminates at the Earth's surface and hydrocarbon production flows from the wellbore into a flowline along a downstream direction from the T-shaped junction;

obtaining real time pressure and temperature readings of the wellhead through the SCADA system;

detecting, using a thermal infrared camera installed at a wellhead tree and flow lines of the well, potential oil/gas leak; and determining, by the SCADA system and based at least on the real time pressure and temperature readings and a detection result of the thermal infrared camera, integrity of the plurality of valves, said plurality of valves and associated gauges comprising:

a well cap at the top of the wellhead for controlling wireline access to the wellbore;

a crown valve (CV) disposed between the T-shaped junction and the well cap for further controlling the wireline access to the wellbore;

a pressure gauge (PG) disposed between the well cap and the CV for measuring a wellhead pressure;

a master valve (MV) disposed between the T-shaped junction and the wellbore for controlling the hydrocarbon production from the wellbore;

a subsurface safety valve (SSSV) disposed below the MV for safety closure of the wellbore, a wing valve (WV) disposed between the T-shaped junction and the flowline for controlling the hydrocarbon production into the flowline;

a choke valve disposed in the flowline downstream from the WV for flow restriction of the hydrocarbon production;

an upstream pressure transmitter (UPT) disposed in the flowline between the WV and the choke valve for measuring pressure data before the hydrocarbon production passing the choke valve;

a downstream pressure transmitter (DPT) disposed in the flowline downstream to the choke valve for measuring the pressure data after the hydrocarbon production passing the choke valve; and a block limit valve (BLV) disposed in the flowline downstream to the DPT for isolating the flowline from the wellhead;

said obtaining real time pressure and temperature readings comprising:

closing, in response to a first control signal from the SCADA system, the SSSV, the MV, the WV, the CV, and the BLV to record an initial downstream pressure using the DPT;

opening, in response to a second control signal from the SCADA system, the SSSV, the MV, the WV, and the CV while keeping the BLV closed to record an initial shut-in wellhead pressure (SIWHP) using the PG; and validating gauge accuracy by comparing gauge readings of the PG, the UPT, and the DPT, and said determining the integrity of the plurality of valves comprising:

determining that the BLV is holding by at least monitoring and comparing the gauge readings of the PG, the UPT, and the DPT with respect to the SIWHP throughout a first pre-determined time period.

2. The method of claim 1, said obtaining real time pressure and temperature readings and determining the integrity of the plurality of valves further comprising:

closing, in response to a third control signal from the SCADA system, the WV and opening the BLV; and determining that the WV is holding by at least comparing the UPT, the DPT, and the initial downstream pressure and comparing the PG and the SIWHP throughout a second pre-determined time period.

3. The method of claim 2, said obtaining real time pressure and temperature readings and determining the integrity of the plurality of valves further comprising:

in response to a fourth control signal from the SCADA system, closing the SSSV and opening the WV to bleed pressure to downstream;

closing, in response to a fifth control signal from the SCADA system, the WV to monitor pressure build-up for 30 minutes at the PG; and determining, based at least on the monitored pressure build up, the integrity of the SSSV.

4. A system for remotely testing wellhead integrity of a well, the system comprising:

a memory; and a computer processor connected to the memory and that:

obtains real time pressure and temperature readings of a plurality valves and associated gauges of a wellhead of the well, the wellhead comprising a T-shaped junction where a wellbore terminates at the Earth's surface and hydrocarbon production flows from the wellbore into a flowline along a downstream direction from the T-shaped junction;

detects, based on images from a thermal infrared camera installed at a wellhead tree and flow lines of the well, potential oil/gas leaks; and determines, based at least on the real time pressure and temperature readings and a detection result of the images, integrity of the plurality of valves, wherein the memory and the computer processor are part of a supervisory control and data acquisition (SCADA) system remote from the well, said plurality of valves and associated gauges comprising:

a well cap at the top of the wellhead for controlling wireline access to the wellbore;

a crown valve (CV) disposed between the T-shaped junction and the well cap for further controlling the wireline access to the wellbore;

a pressure gauge (PG) disposed between the well cap and the CV for measuring a wellhead pressure;

a master valve (MV) disposed between the T-shaped junction and the wellbore for controlling the hydrocarbon production from the wellbore;

a subsurface safety valve (SSSV) disposed below the MV for safety closure of the wellbore, a wing valve (WV) disposed between the T-shaped junction and the flowline for controlling the hydrocarbon production into the flowline;

a choke valve disposed in the flowline downstream from the WV for flow restriction of the hydrocarbon production;

an upstream pressure transmitter (UPT) disposed in the flowline between the WV and the choke valve for measuring pressure data before the hydrocarbon production passing the choke valve;

a downstream pressure transmitter (DPT) disposed in the flowline downstream to the choke valve for measuring the pressure data after the hydrocarbon production passing the choke valve; and a block limit valve (BLV) disposed in the flowline downstream to the DPT for isolating the flowline from the wellhead;

said obtaining real time pressure and temperature readings comprising:

closing, in response to a first control signal from the SCADA system, the SSSV, the MV, the WV, the CV, and the BLV to record an initial downstream pressure using the DPT;

opening, in response to a second control signal from the SCADA system, the SSSV, the MV, the WV, and the CV while keeping the BLV closed to record an initial shut-in wellhead pressure (SIWHP) using the PG; and validating gauge accuracy by comparing gauge readings of the PG, the UPT, and the DPT, and said determining the integrity of the plurality of valves comprising:

determining that the BLV is holding by at least monitoring and comparing the gauge readings of the PG, the UPT, and the DPT with respect to the SIWHP throughout a first pre-determined time period.

5. The system of claim 4, said obtaining real time pressure and temperature readings and determining the integrity of the plurality of valves further comprising:

sending a third control signal to close the WV and opening the BLV; and determining that the WV is holding by at least comparing the UPT, the DPT, and the initial downstream pressure and comparing the PG and the SIWHP throughout a second pre-determined time period.

6. The system of claim 5, said obtaining real time pressure and temperature readings and determining the integrity of the plurality of valves further comprising:

sending a fourth control signal to close the SSSV and open the WV to bleed pressure to downstream;

sending a fifth control signal to close the WV to monitor pressure build-up for 30 minutes at the PG; and determining, based at least on the monitored pressure build up, the integrity of the SSSV.

7. A non-transitory computer readable medium (CRM) storing computer readable program code for remotely testing wellhead integrity of a well, wherein the computer readable program code, when executed by a computer, comprises functionality for:

connecting a plurality valves and associated gauges of a wellhead of the well remotely to a supervisory control and data acquisition (SCADA) system, the wellhead comprising a T-shaped junction where a wellbore terminates at the Earth's surface and hydrocarbon production flows from the wellbore into a flowline along a downstream direction from the T-shaped junction;

obtaining real time pressure and temperature readings of the wellhead through the SCADA system;

detecting, using a thermal infrared camera installed at a wellhead tree and flow lines of the well, potential oil/gas leak; and determining, by the SCADA system and based at least on the real time pressure and temperature readings and a detection result of the thermal infrared camera, integrity of the plurality of valves, said plurality of valves and associated gauges comprising:

a well cap at the top of the wellhead for controlling wireline access to the wellbore;

a crown valve (CV) disposed between the T-shaped junction and the well cap for further controlling the wireline access to the wellbore;

a pressure gauge (PG) disposed between the well cap and the CV for measuring a wellhead pressure;

a master valve (MV) disposed between the T-shaped junction and the wellbore for controlling the hydrocarbon production from the wellbore;

a subsurface safety valve (SSSV) disposed below the MV for safety closure of the wellbore, a wing valve (WV) disposed between the T-shaped junction and the flowline for controlling the hydrocarbon production into the flowline;

a choke valve disposed in the flowline downstream from the WV for flow restriction of the hydrocarbon production;

an upstream pressure transmitter (UPT) disposed in the flowline between the WV and the choke valve for measuring pressure data before the hydrocarbon production passing the choke valve;

a downstream pressure transmitter (DPT) disposed in the flowline downstream to the choke valve for measuring the pressure data after the hydrocarbon production passing the choke valve; and a block limit valve (BLV) disposed in the flowline downstream to the DPT for isolating the flowline from the wellhead;

said obtaining real time pressure and temperature readings comprising:

closing, in response to a first control signal from the SCADA system, the SSSV, the MV, the WV, the CV, and the BLV to record an initial downstream pressure using the DPT;

opening, in response to a second control signal from the SCADA system, the SSSV, the MV, the WV, and the CV while keeping the BLV closed to record an initial shut-in wellhead pressure (SIWHP) using the PG; and validating gauge accuracy by comparing gauge readings of the PG, the UPT, and the DPT, and said determining the integrity of the plurality of valves comprising:

determining that the BLV is holding by at least monitoring and comparing the gauge readings of the PG, the UPT, and the DPT with respect to the SIWHP throughout a first pre-determined time period.

8. The non-transitory CRM of claim 7, said obtaining real time pressure and temperature readings and determining the integrity of the plurality of valves further comprising:

closing, in response to a third control signal from the SCADA system, the WV and opening the BLV;

determining that the WV is holding by at least comparing the UPT, the DPT, and the initial downstream pressure and comparing the PG and the SIWHP throughout a second pre-determined time period; and in response to a fourth control signal from the SCADA system, closing the SSSV and opening the WV to bleed pressure to downstream;

closing, in response to a fifth control signal from the SCADA system, the WV to monitor pressure build-up for 30 minutes at the PG; and determining, based at least on the monitored pressure build up, the integrity of the SSSV.

* * * * *